United States Patent [19]

Mowbray

[11] 4,214,562

[45] Jul. 29, 1980

[54] VALVE CONTROL ARRANGEMENTS

[75] Inventor: Dorian F. Mowbray, Burnham, England

[73] Assignee: Lucas Industries Limited, Birmingham, England

[21] Appl. No.: 919,975

[22] Filed: Jun. 28, 1978

[30] Foreign Application Priority Data

Jul. 8, 1977 [GB] United Kingdom ..... 28820/77

[51] Int. Cl.[2] ..... F02M 25/00

[52] U.S. Cl. ..... 123/568

[58] Field of Search ..... 123/119 A

[56] References Cited

U.S. PATENT DOCUMENTS

| | | | |
|---|---|---|---|
| 1,679,521 | 8/1928 | Good | 123/119 A |
| 3,802,402 | 4/1974 | Swatman | 123/119 A |
| 3,807,376 | 4/1974 | Glockler | 123/119 A |
| 4,073,202 | 2/1978 | Aoyama | 123/119 A |

FOREIGN PATENT DOCUMENTS

| | | | |
|---|---|---|---|
| 784975 | 10/1957 | United Kingdom | 123/119 A |

*Primary Examiner*—Ronald H. Lazarus

[57] ABSTRACT

The invention relates to a valve control arrangement for controlling the flow of exhaust gas from an exhaust manifold to an air inlet of an internal combustion engine which is supplied with fuel by a fuel pump. The quantity control member of the pump is connected through linkage to a valve through which exhaust gas can flow into a conduit connected to the air inlet manifold. In this manner the quantity of exhaust gas recirculated depends upon the setting the control member of the pump. A further valve is positioned upstream so far as exhaust gas is concerned, of the valve and the further valve is adjusted so that it maintains the pressure drop across the first mentioned valve substantially constant. This is achieved in the example, by means of a diaphragm opposite sides of which are responsive to the pressure on opposite sides of the first mentioned valve.

4 Claims, 1 Drawing Figure

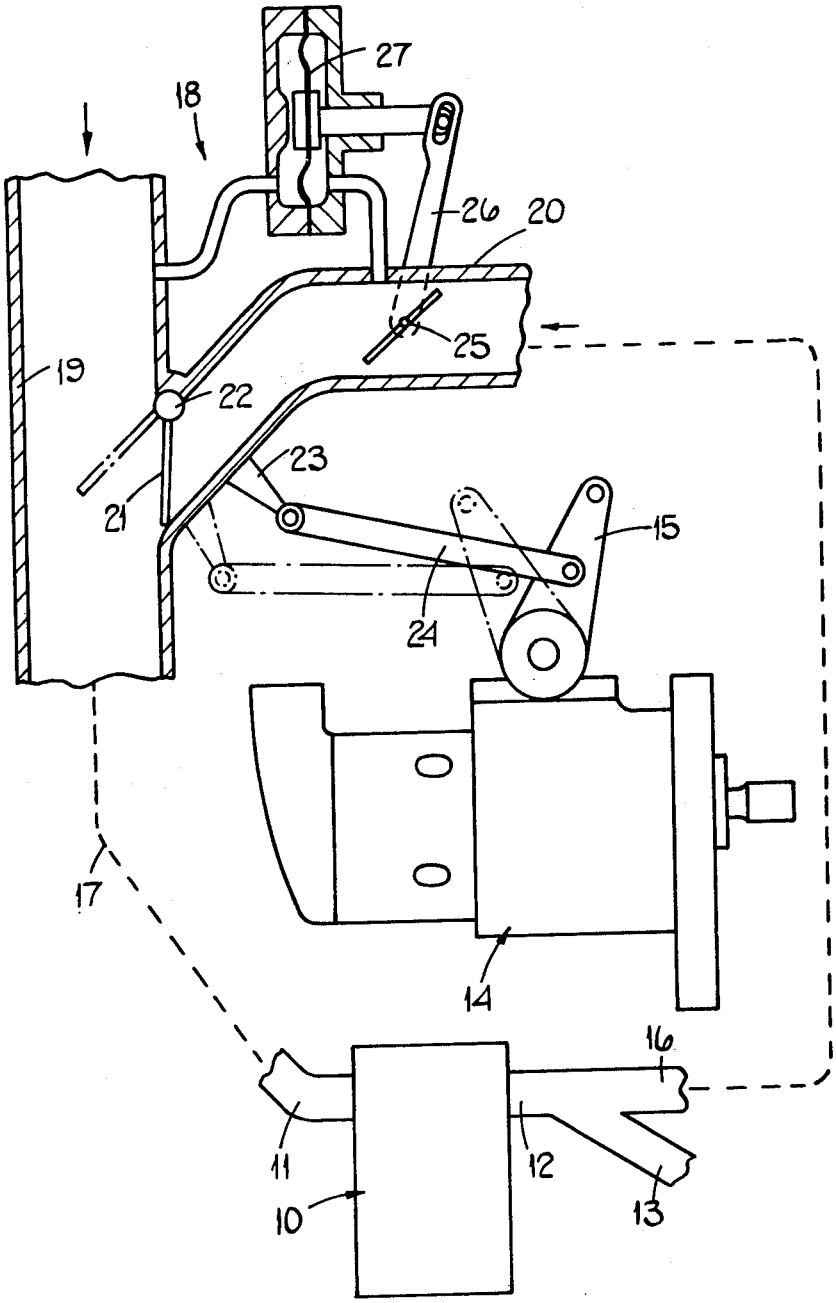
27
18
26
20
25
19
22
23
21
15
24
17
14
16
11
12
13
10

VALVE CONTROL ARRANGEMENTS

This invention relates to valve control arrangements for controlling the flow of exhaust gas from an exhaust manifold to an air inlet of an internal combustion engine, the arrangement including a flow control valve operable by mechanism associated with the engine.

Valve control arrangements for the purpose specified are known in which the flow control valve is a balanced valve so that the torque required to operate the valve is substantially constant throughout the range of movement and in addition is as small as possible to avoid undue loading of the aforesaid mechanism. Moreover, it is often required that the amount of exhaust gas which passes through the flow control valve should depend on the position of a control member of the valve and be substantially independent of variable factors such for instance as the condition of the exhaust system and air inlet system of the engine.

According to the invention a valve control arrangement for the purpose specified comprises upstream of the flow control valve and in a position to influence the flow of exhaust gas, a throttle valve, and means responsive to the pressure drop across the flow control valve for actuating said throttle valve whereby the pressure drop across the flow control valve is substantially zero.

According to a further feature of the invention said flow control valve comprises a flap valve disposed at the junction of a first conduit connected to the exhaust manifold and a second conduit through which air flows in use to the air inlet, and said throttle valve is a butterfly valve.

According to a still further feature of the invention said means comprises a diaphragm subjected on opposite sides respective to the pressure upstream and downstream of said flow control valve.

According to another aspect of the invention a control arrangement for the purpose specified comprises a first conduit portion forming in use, part of the air inlet system of the engine, a second conduit portion jointed to said first conduit portion, said flow control valve comprising a flap valve hinged at the upstream portion of the joint between the two conduit portions and operable in use, by mechanism associated with the engine, a butterfly valve disposed in said second conduit portion and means responsive to the pressure drop across said flap valve for adjusting the butterfly valve so that the pressure drop across the flap valve is substantially zero, said second conduit portion in use being connected to the exhaust manifold of the engine.

One example of a valve control arrangement in accordance with the invention will now be described with reference to the accompanying drawing:

Referring to the drawing there is provided an engine which is indicated at 10 and which has an air inlet manifold 11 and an exhaust manifold 12. The exhaust manifold is connected to an exhaust pipe 13 which leads to the usual silencer etc. The engine is a compression ignition engine and fuel is supplied to the engine by a fuel pump which is indicated at 14, the pump being driven in timed relationship with the engine and supplying fuel to the injection nozzles of the engine in turn.

The pump 14 incorporates a governor mechanism of the type known as a "two-speed governor". This type of governor controls the idling speed of the engine when a control 15 is set to the minimum fuel position and it also controls the maximum speed of the engine when the control is set to the maximum fuel position. The control 15 in in use is coupled to a driver operated control member commonly known as the throttle control.

It is known with such engines to allow some exhaust gas to flow to the inlet manifold of the engine the purpose in this particular case, being to reduce the noxious gas content of the exhaust.

For this purpose a branch conduit 16 extends from the exhaust manifold and is connected to a conduit 17 which conveys air to the inlet manifold. In practice, the conduit 17 will be connected to an air filter of the conventional type. It is necessary however to control the amount of exhaust gas which is supplied to the air inlet manifold in accordance with the amount of fuel which is being supplied to the engine. For this purpose,, a control arrangement is provided which is coupled to the fuel pump.

The control arrangement is generally indicated at 18 and it comprises a first conduit portion 19 which forms part of the conduit 17, and a second conduit portion 20 which forms part of the conduit 16. The two conduit portions 19, 20 join each other at an angle, the angle being such that exhaust gas flowing through the conduit portion 20 will enter the conduit portion 19 and will be directed in the downstream direction in the sense of the air flow through the conduit portion 19.

At the junction of the two conduit portions there is provided a flap valve which includes a flap 21 which is mounted about a pivot axis 22 and which is coupled to a control member 23. The pivot axis 22 is positioned at the upstream portion of the joint between the two conduits and is movable between a closed position which is shown in full line and an open position which is shown in dotted outline.

The control member 23 of the flap valve is coupled by a link 24 to the control 15 of the pump and the arrangement is such that as the control 15 is moved to increase the quantity of fuel supplied to the engine, the flap 21 is moved further into the conduit portion 19 thereby to allow more exhaust gas to flow into the inlet manifold. As described the flap would tend to be moved to its open position by the action of the exhaust gas and this would impose a load on the linkage connected to the control 15. It would be possible to design the valve which is constituted by the flap 21 in such a manner that it would be pressure balanced but such a valve would be physically larger and would possibly be more prone to fouling by exhaust deposits.

The control arrangement includes upstream of the flap valve and mounted in the conduit portion 20, a butterfly valve 25. Such a valve can be designed so that it is substantially pressure balanced. The valve 25 is connected to an external lever 26 and this is coupled to a diaphragm 27 which divides a chamber into two parts. The two parts of the chamber are connected to points in the conduit portions 19 and 20 on opposite sides of the flap valve and the effect of the diaphragm is to control the position of the butterfly valve 25 so that the pressure drop across the flap valve is substantially zero. In this manner the load which is imposed upon the linkage connected to the control 15 is also substantially zero.

It may be desirable to incorporate in the exhaust pipe 13 an orifice plate or other restrictor to ensure that there is sufficient exhaust gas pressure available to cause exhaust gas to flow through the conduit 16. Moreover, it may be desirable to limit the movement of the control member 23 by means of stops and if this is done it may be necessary to incorporate in the link 24, a lost motion connection.

With the arrangement as described the construction of the valve is controlled by the control member 15 is simplified. In addition inevitable deterioration in the condition of the air filter and the exhaust system does not affect the proportion of exhaust gas which is directed into the air inlet manifold when the engine is in use.

I claim:

1. An internal combustion engine provided with a system for controlling the flow of exhaust gas from an exhaust manifold to an air inlet of the internal combustion engine, said system comprising a first conduit portion forming part of the air inlet system of the engine, a second conduit portion joined to said first conduit portion, a flow control valve comprising a flap valve hinged at the upstream portion of said first conduit at its juncture with said second conduit and operable by means associated with the engine in response to the fuel requirements thereof, a butterfly valve disposed in said second conduit portion and means responsive to the pressure drop across said flap valve for adjusting the butterfly valve so that the pressure drop across the flap valve is substantially zero, said second conduit portion being connected to the exhaust manifold of the engine.

2. A control arrangement according to claim 1 in which said means responsive to the pressure drop across said flap valve comprises a diaphragm subjected on opposite sides respectively to the pressure upstream and downstream of said flow control valve.

3. A control arrangement according to claim 2 in which said means associated with the engine comprises the control member of a fuel pump for supplying fuel to the engine.

4. A control arrangement according to claim 2, including a lost motion connection interposed between the control member and said flow control valve.

* * * * *